United States Patent [19]

Hansen

[11] 3,944,080

[45] Mar. 16, 1976

[54] HANGING FILE FOLDER SUPPORT STRUCTURE

[75] Inventor: Harland W. Hansen, Muskegon, Mich.

[73] Assignee: The Shaw-Walker Company, Muskegon, Mich.

[22] Filed: Mar. 17, 1975

[21] Appl. No.: 558,924

[52] U.S. Cl. ..... 211/46; 248/39; 312/184

[51] Int. Cl.[2] ..... A47F 63/00

[58] Field of Search ..... 211/46, 49, 50, 177; 248/39, 42, 43; 312/184, 185

[56] References Cited

UNITED STATES PATENTS

| | | | |
|---|---|---|---|
| 1,610,730 | 12/1926 | Baler | 108/144 |
| 1,790,803 | 2/1931 | Francis | 248/39 |
| 2,810,388 | 10/1957 | Conely et al. | 211/46 |
| 3,283,912 | 11/1966 | Cullen | 211/46 |

*Primary Examiner*—Casmir A. Nunberg

*Attorney, Agent, or Firm*—Kinzer, Plyer, Dorn & McEachran

[57] ABSTRACT

A structure for supporting hanging file folders in a file drawer. The structure includes a pair of wire members which are adapted to be installed in a file drawer in lateral spaced relation to each other. Each wire member includes an elongated generally straight center portion which receives and supports the file folders and a leg positioned at each end of the center portion. Each of the legs is in the shape of an inverted L and includes a horizontally extending portion which connects to the center portion of the wire member. This horizontally extending portion projects at right angles to the center portion. A vertical portion of each leg which connects to the horizontal portion of its leg is adapted to be inserted in supporting bosses. The supporting bosses may be formed in rectangular plates located at each end of the pair of wire members or may be formed in the end panels of the file drawer. The wire members are formed of stock having a transverse cross section of generally rectangular shape.

3 Claims, 5 Drawing Figures fig.1.
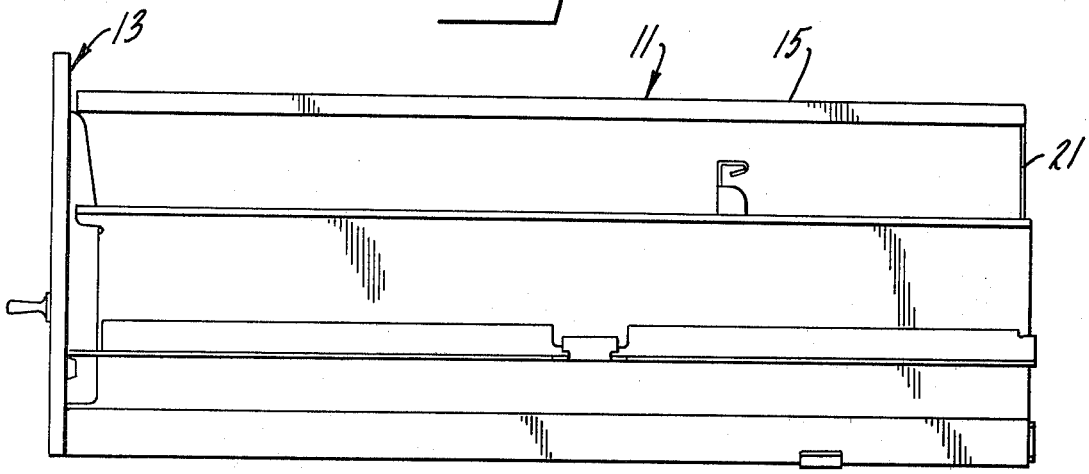
fig.2.
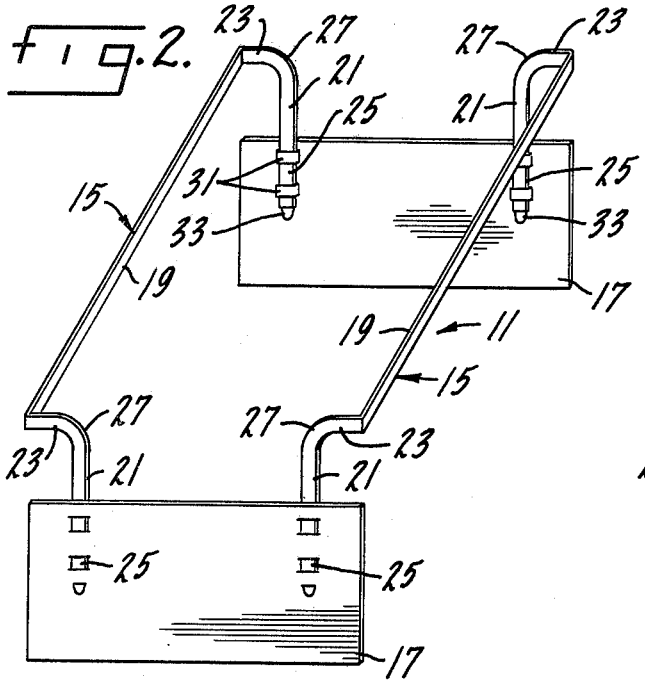
fig.3.
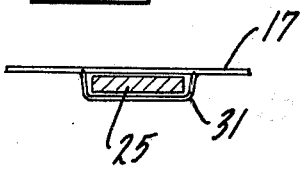
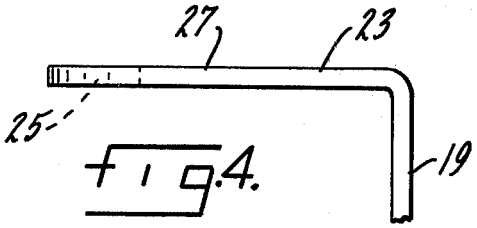
fig.4.
fig.5.
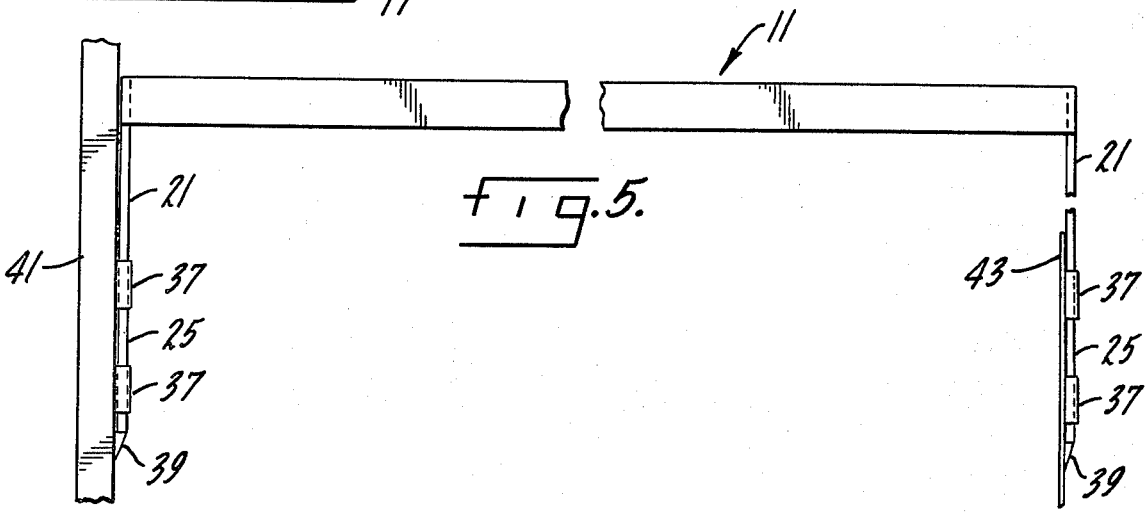

HANGING FILE FOLDER SUPPORT STRUCTURE

SUMMARY OF THE INVENTION

This invention is concerned with a support structure for hanging file folders and more particularly with a support structure which can be shipped in a knocked down condition and which can be readily assembled at the point of use without the use of any tools.

An object of this invention is a support structure for hanging file folders which may be installed in existing file drawers without requiring modification of the drawers.

Another object is a support structure for hanging file folders which uses a minimum number of parts which can be easily assembled.

Another object is a support structure for hanging file folders which is made from parts of simplified design.

Another object is a support structure for hanging file folders which can easily be adaptable to fit into either letter or legal size file drawers.

Other objects may be found in the following specification, claims and drawings.

BRIEF DESCRIPTION OF THE DRAWINGS

The invention is illustrated more or less diagramatically in the following drawings wherein:

FIG. 1 is a side elevational view of a hanging file folder support structure of this invention installed in a conventional file drawer;

FIG. 2 is a prospective view of one embodiment of the support structure of this invention;

FIG. 3 is an enlarged partial cross-sectional view of a portion of the support structure;

FIG. 4 is an enlarged partial view of another portion of the support structure; and FIG. 5 is a partial side elevational view of a second embodiment of the support structure of this invention installed in a file drawer especially designed for this embodiment of the support structure.

DESCRIPTION OF THE PREFERRED EMBODIMENTS

FIG. 1 of the drawings shows a hanging file folder support structure 11 constructed in accordance with the teachings of this invention installed in a conventional file drawer 13. As it is clearly shown in FIG. 2, the support structure 11 includes wire members 15 and end plates 17. Each wire member is formed of stock of generally rectangular cross section and includes an elongated generally straight center portion 19 having a leg 21 at each end thereof. The legs are formed integrally from the same piece of wire stock by bending the wire to the desired configuration which in this instance is an inverted generally L-shaped configuration. Each leg has a horizontal portion 23 which connects to the center portion 19 of wire member and a vertically extending portion 25. The horizontal and vertical portions of each leg are connected by an integral curved portion 27.

In the embodiment of the invention shown in FIG. 2 of the drawings, the vertical portions 25 of the legs 21 fit into sets of embossed loops 31 formed in the end plates 17. The bottom boss 33 of each set of bosses acts as a support for the leg while the embossed loops hold the leg in position against the plates. The plates 17 are formed with widths and heights suitable so that they can easily fit inside a standard file drawer which may be either letter or legal size with the end plates 17 positioned at the front and rear of the drawer.

A slightly modified embodiment of the invention is shown in FIG. 5 of the drawings. In this modification, the end plates 17 are not used. Instead, the vertical portions 25 of the legs 21 are inserted in embossed loops 37 and bosses 39 formed in the end heads of the file drawer. In the file drawer shown in FIG. 5, the embossed loops 37 and bosses 39 on the inner head 41 at the front of the drawer project inwardly while the embossed loops 37 and bosses 39 on the head 43 at the rear of the drawer project outwardly. It should be understood and appreciated that the direction of projection of the bosses and embossed loops on the rear head 43 may be reversed so that they project inwardly of the drawer. The embodiment of the invention shown in FIG. 5 eliminates the need for the end plates 17. Thus, it should be apparent that the wire members 15 may be used either with the end plates 17 of FIG. 2 or with a specially prepared file drawer of the type shown in FIG. 5.

It should also be apparent that the wire members 15 and the end plates 17 can be shipped in the knocked down or unassembled state. At the point of use, the plates and wire members can easily be assembled and installed in the file cabinet drawer. In specially constructed file cabinet drawers of the type shown in FIG. 5, the end plates would not be necessary since the wire members 15 can be inserted into the embossed loops and bosses 37 and 39 constructed in the front and rear heads of the drawer.

I claim:

1. A support structure for hanging file folders, said structure including a pair of separate wire members adapted to be installed in a file drawer in lateral spaced relation to each other, each wire member including an elongated generally straight center portion which receives and supports the file folders and a leg located at each end of said center portion, each of said legs having the shape of an inverted L and including a horizontally extending portion connected to said center portion of said wire member and projecting at right angles thereto and a vertical portion which is adapted to be inserted in supporting bosses and embossed loops.

2. The support structure of claim 1 in which a generally rectangular plate is positioned at each end of said pair of wire members and each plate has sets of bosses and embossed loops which receive and support said legs.

3. The support structure of claim 1 in which each of said wire member has a transverse cross-section of generally rectangular shape.

* * * * *